United States Patent [19]

Rowe et al.

[11] 4,320,987

[45] Mar. 23, 1982

[54] CONCRETE VIBRATOR MACHINE

[75] Inventors: Murray A. Rowe, Canton, S. Dak.; Herbert C. Glesmann, Omaha, Nebr.; Ewald Ulmer, Canton, S. Dak.

[73] Assignee: CMI Corporation, Oklahoma City, Okla.

[21] Appl. No.: 89,170

[22] Filed: Oct. 29, 1979

[51] Int. Cl.[3] ..... E01C 19/38

[52] U.S. Cl. ..... 404/115

[58] Field of Search ..... 404/115, 119, 116, 101, 404/83, 72, 96, 106

[56] References Cited

U.S. PATENT DOCUMENTS

| | | | |
|---|---|---|---|
| 2,292,733 | 8/1942 | Baily | 404/116 |
| 2,583,108 | 1/1952 | Lewik | 404/101 |
| 2,603,132 | 7/1952 | Miller | 404/119 |
| 2,744,456 | 5/1956 | Mittelstadt | 404/116 |
| 3,098,415 | 7/1963 | Guntert | 404/102 |
| 3,253,522 | 5/1966 | Piper | 404/113 |
| 3,368,466 | 2/1968 | Rowe | 404/119 |
| 3,392,641 | 7/1968 | Kessel | 404/106 X |
| 3,753,621 | 8/1973 | Dale | 404/116 |

*Primary Examiner*—Nile C. Byers, Jr.

*Attorney, Agent, or Firm*—Emrich, Root, Lee, Brown & Hill

[57] ABSTRACT

A concrete vibrator machine movable longitudinally of a roadway, or the like, with a vibrator unit movable back and forth transversely of the roadway, with the vibrator mechanism thereof disposed in the concrete to be vibrated, and with the vibrator mechanism being raisable and lowerable relative to the concrete to be vibrated.

14 Claims, 9 Drawing Figures

CONCRETE VIBRATOR MACHINE

BACKGROUND OF THE INVENTION

This invention relates to concrete vibrator machines, and, more particularly, to concrete vibrator machines which are particularly well adapted for use in conjunction with a concrete finishing machine for use on highways, and the like.

A primary object of the present invention is to afford a novel concrete vibrator machine.

Another object of the present invention is to afford a novel concrete vibrator machine for use in vibrating concrete ahead of a concrete finishing machine.

Concrete vibrator machines for use in vibrating concrete ahead of concrete finishing machines on highways, and the like, have been heretofore known in the art, being shown, for example, in Baily U.S. Pat. No. 2,255,344, Snow et. al. U.S. Pat. No. 3,540,360, Dale U.S. Pat. No. 3,653,621 and Cooper U.S. Pat. No. 4,128,359, which disclose concrete vibrator machines wherein the vibrators are moved into and out of concrete to be vibrated in a substantially vertical or rearwardly extending direction and moved forwardly along, or laterally across a highway or the like, in a step-like movement, and also being shown, for example, in Pierce Pat. No. 2,382,096 and Jackson U.S. Pat. No. 2,582,486, which disclose concrete vibrator machines wherein the vibrators are dragged forwardly along the highway, or the like, ahead of the concrete finishing machine. Also, concrete vibrator machines for such use have been heretofore known in the art wherein the vibrators are disposed in the concrete at all times and are dragged back and forth across the highway, or the like. It is an important object of the present invention to afford improvements over concrete vibrator machines of the aforementioned type heretofore known in the art.

Another object of the present invention is to afford a novel concrete vibrator machine wherein the vibrators thereof move through the concrete to be vibrated in a direction laterally of the highway, or the like, on which the concrete is being laid.

Another object of the present invention is to afford a novel concrete vibrator machine of the aforementioned type wherein the vibrators are raised and lowered from the concrete in a novel and expeditious manner.

Yet another object of the present invention is to afford a novel concrete vibrator machine of the aforementioned type wherein the raising and lowering of the vibrators is controlled in a novel and expeditious manner.

A further object of the present invention is to afford a novel concrete vibrator machine of the aforementioned type, which may be embodied, in a novel and expeditious manner, in a concrete finishing machine, as an integral part thereof.

Another object of the present invention is to afford a novel concrete vibrating machine of the aforementioned type which is practical and efficient in operation and which may be readily and economically produced commercially.

Other and further objects of the present invention will be apparent from the following description and claims and are illustrated in the accompanying drawings which, by way of illustration, show a preferred embodiment of the present invention and the principles thereof and what we now consider to be the best mode in which we have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
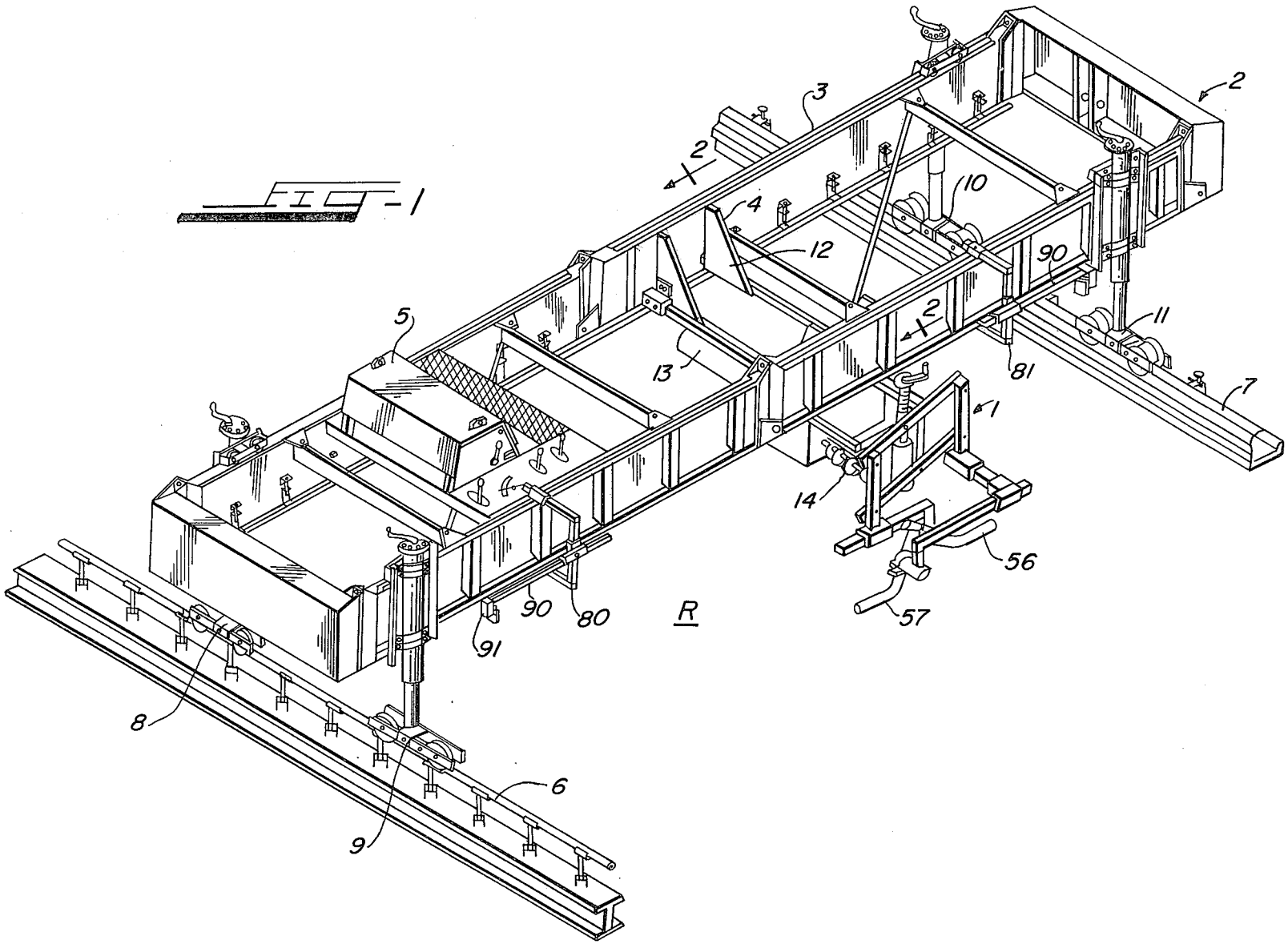
FIG. 1 is a front perspective view of a concrete vibrator machine embodying the principles of the present invention, with the machine embodied in a concrete finishing machine, as an integral part thereof, and disposed in operative position over a roadway.

A concrete vibrator machine 1, embodying the principles of the present invention, is shown in the drawings mounted on, and as an integral part of a concrete finishing machine 2 to illustrate the presently preferred embodiment of the present invention. The machine 2 is shown in FIG. 1 disposed in operative position over a section R of a concrete roadway.

The machine 2, shown in the drawings, is of the type disclosed in United States Letters Pat. No. 3,738,763, issued to Herbert C. Glesmann on June 12, 1973. However, as will be appreciated by those skilled in the art, this is merely by way of illustration and not by way of limitation, and the concrete vibrator machine 1 may be used on other suitable types of concrete finishing machines, or as a separate machine, without departing from the purview of the broader aspects of the present invention.

The concrete finishing machine 2 embodies, in general, an elongated trusswork or frame 3 on which is mounted a surfacing unit 4, which is movable longitudinally of the frame 3, with a control console 5 mounted on the frame 3 from which an operator may control operation of the machine 2. The frame 3 is adapted to extend transversely of the roadway 2 being finished, and the machine 2 is adapted to be moved lengthwise of the roadway in a direction transverse to the length of the frame 3.

In the arrangement of the machine 2 shown in FIG. 1, upright, horizontally extending supports 6 and 7 are positioned on opposite sides of the roadway 2 and extend lengthwise thereof, the upper edges of the supports 6 and 7 being adapted to operatively receive a pair of bogies 8 and 9 and a pair of bogies 10 and 11, respectively, mounted on opposite ends of the frame 3, to enable the frame 3 to be moved along the supports 6 and 7.

Figure 2:
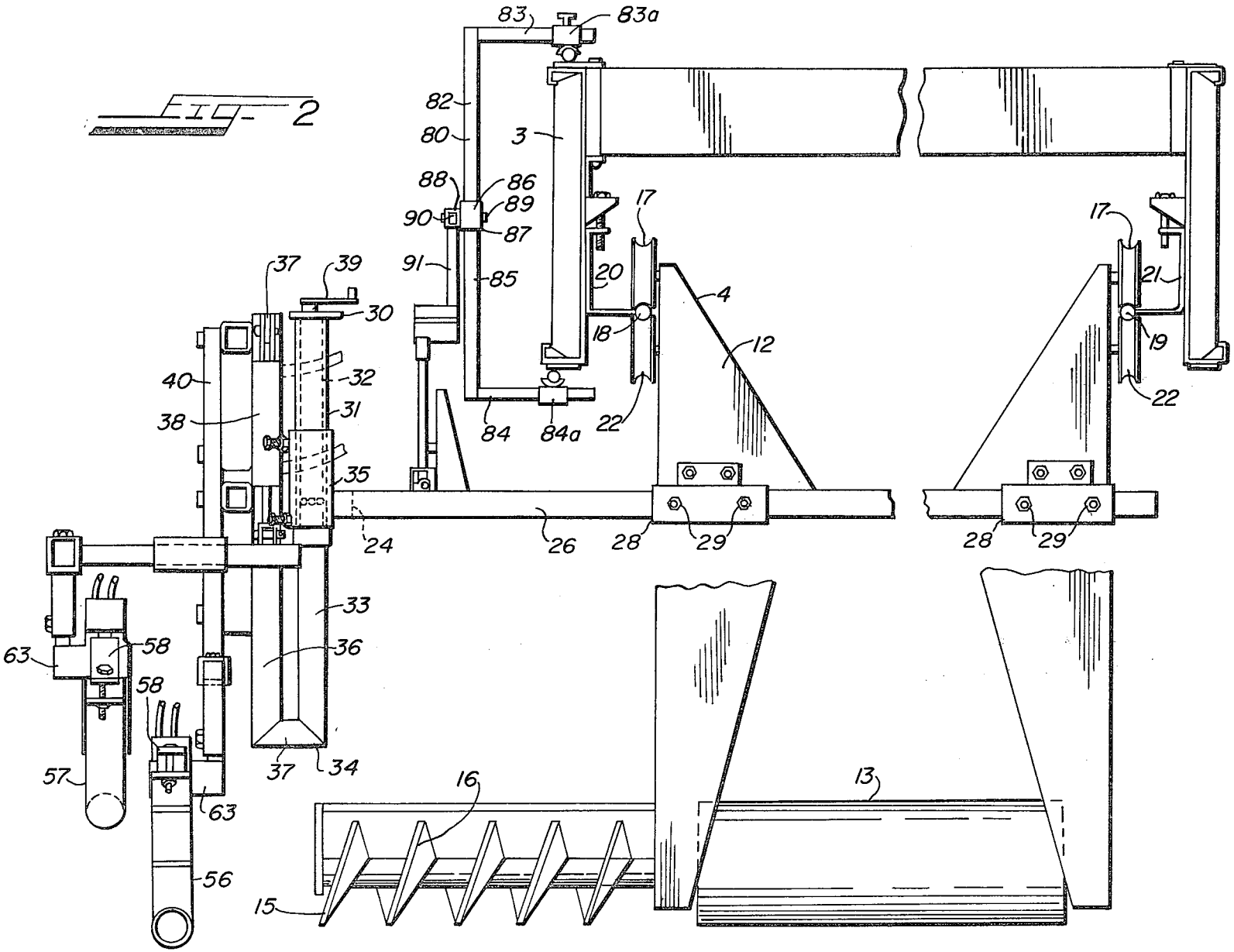
FIG. 2 is a fragmentary sectional view taken substantially along the line 2—2 in FIG. 1.
Figure 3:
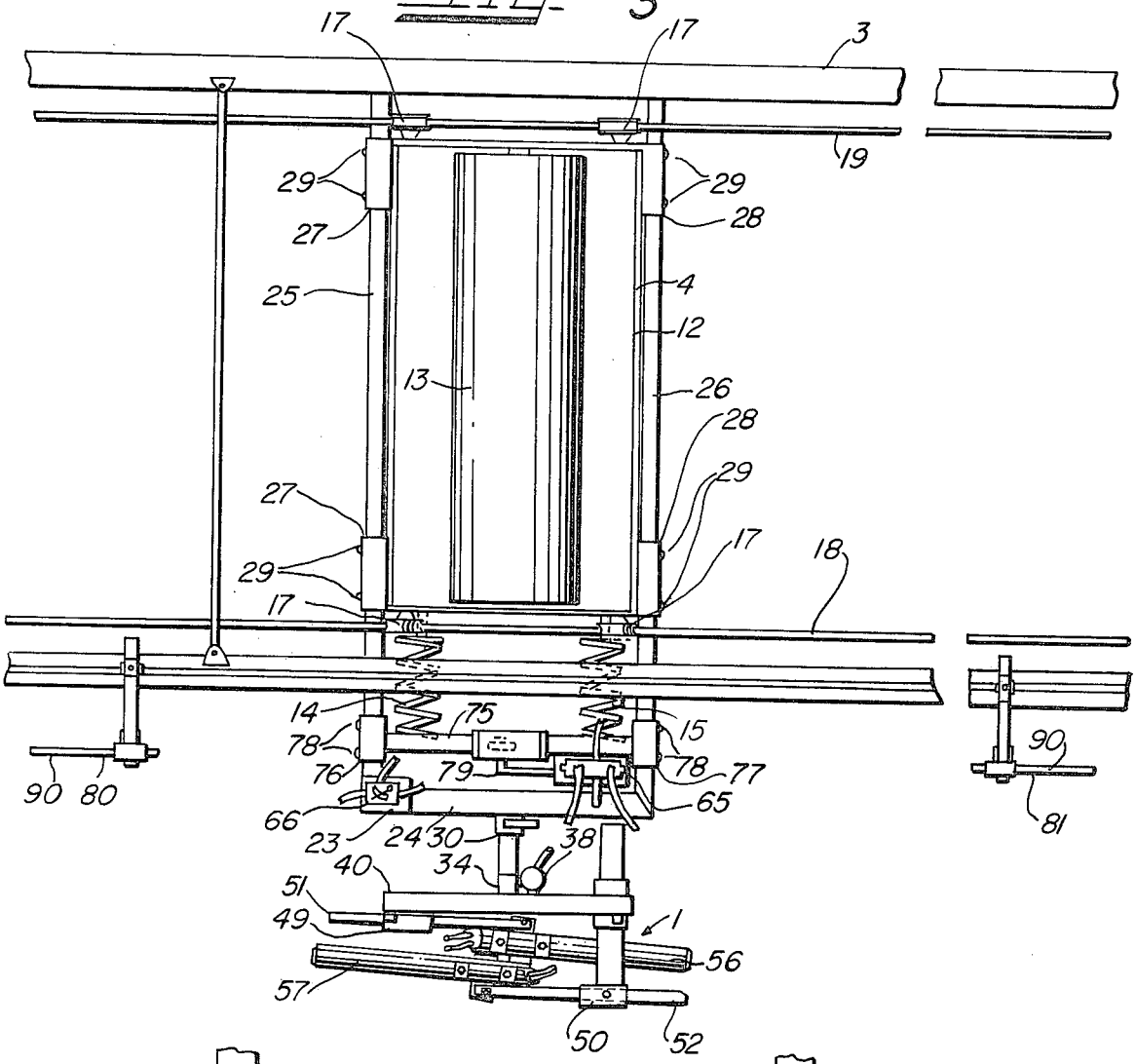
FIG. 3 is a fragmentary top plan view of the machine shown in FIG. 1.

The surfacing unit 4 is mounted on and suspended from the frame 3, FIGS. 1–3. It includes an elongated carriage 12 having a substantially horizontally extending, elongated concrete-smoothing member in the form of an elongated cylinder 13, journaled in and suspended from the lower portion of the carriage 12 and movable therewith.

Two elongated conveyor screws or augers 14 and 15 are disposed forwardly of the front end of the cylinder 13, at opposite sides thereof, in substantially horizontal, uniplanar, spaced relation to each other, FIGS. 1 and 3. The helical blades 16 of the conveyor screws 14 and 15 are so constituted and arranged that rotation of the screws 14 and 15 during operation of the machine 2 is effective to rotate the blades 16 in such direction that material engaged thereby tends to move toward the space between the conveyor screws 14 and 15 as well as longitudinally outwardly along the conveyor screws 14 and 15 away from the cylinder 13. With this construction, as is true of the machine shown in Rowe et al U.S. Pat. No. 3,528,348, which issued Sept. 15, 1970, engagement of the conveyor screws 14 and 15 with concrete material during movement of the concrete-smoothing member 13 in either transverse direction, is effective not only to move the engaged material outwardly longitudinally of the screw 14 or 15, but is also effective to move the material inwardly to a position wherein the two screws 14 and 15 tends to confine it between them, and both screws are effective to move the material longitudinally outwardly ahead of the remainder of the surfacing unit 4.

The carriage 12 of the surfacing unit 4, FIGS. 2 and 3, has two pairs of outwardly projecting, horizontally spaced rollers 17 mounted on respective ends thereof in such position that in the assembled machine 2, the rollers 17 are disposed in position to be supported by, and ride along the inner edges of elongated tracks 18 and 19 disposed on opposite sides of the frame 3, to thereby support the surfacing unit 4 for movement longitudinally of the trusswork 3. The tracks 18 and 19 are supported from the sides of the frame 3 by vertically adjustable hangers 20 and 21, respectively, so that the level of the tracks 18 and 19 at various points along the frame 3 may be adjusted.

A pair of hold down rollers 22 are mounted on each of the ends of the carriage 12 below the respective pair of upper rollers 17, FIG. 2. The rollers 22 are disposed in such position that when the carriage 12 is supported on the tracks 18 and 19, the rollers 22 are disposed in abutting engagement with the lower faces of the adjacent tracks 18 and 19 in position to hold the rollers 17 downwardly against the tracks 18 and 19.

The operation of the machine 2 is the same as that of the machine shown in the aforementioned Glesmann Pat. No. 3,738,763. That is, it is intermittently moved longitudinally of the roadway 2 on the rails 6 and 7 by suitable drive mechanism, not shown, on the bogies 8–11, and between each such movement of the machine 2 longitudinally of the roadway 2, the surfacing unit 4 is moved transversely across the roadway 2 by suitable drive mechanism, not shown. Control of the operation of the machine 2 may be effected both manually and automatically in the same manner as that disclosed in the aforementioned Glesmann Pat. No. 3,738,763 with respect to the machine shown therein.

The concrete vibrator machine 1, shown in the drawings, is mounted on the surfacing unit 4, for movement therewith, in forwardly projecting relation to the latter. For this purpose, it embodies a substantially U-shaped supporting frame 23, FIG. 3, embodying an elongated front member 24, disposed forwardly of the carriage 3, and from the opposite ends of which two elongated, substantially parallel legs 25 and 26 project rearwardly under the supporting frame 3 on respective opposite sides of the carriage 12. Each of the legs 25 and 26 is disposed in a respective pair of sleeves 27 and 28 mounted on respective sides of the carriage 12, FIG. 3. The legs 25 and 26 are slidably mounted in the sleeves 27 and 28, respectively, for forward and rearward movement therethrough relative to the frame 3, for adjusting the forward position of the concrete vibrator machine 1 relative to the concrete finishing machine 2. The legs 25 and 26 may be releasably secured in adjusted position in the respective pair of sleeves 27 and 28 by suitable means such as bolts 29.

Figure 4:
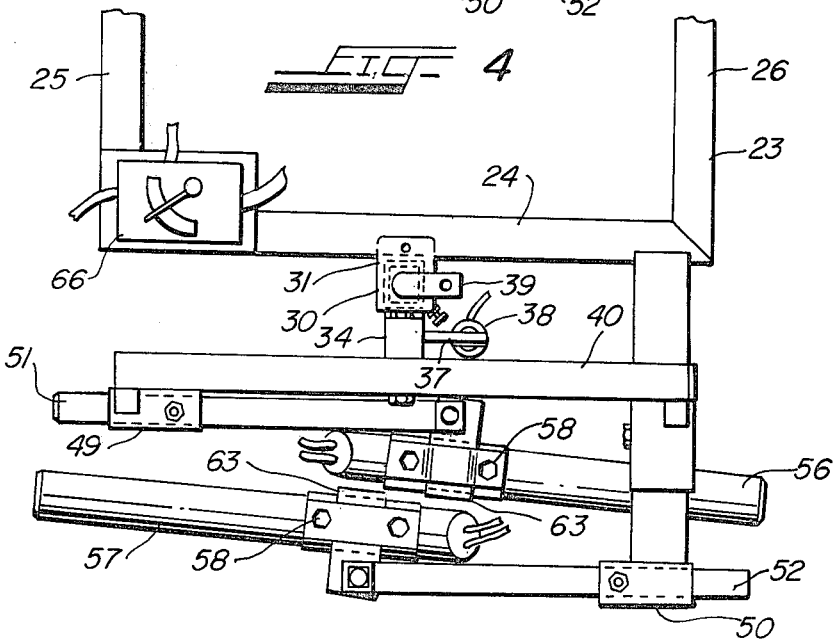
FIG. 4 is an enlarged, fragmentary plan view of a portion of the concrete vibrator machine shown in FIG. 3.

A vertical adjustment mechanism 30 is mounted on the front member 24 of the supporting frame 23, FIGS. 2–4, for a purpose which will be discussed in greater detail presently. The adjustment mechanism 30 embodies an elongated cylinder 31 having a feed screw 32 threadedly mounted therein, with the lower end of the feed screw 32 rotatably secured, by a connection, not shown, to the upper end of a leg 33 of a substantially U-shaped member 34, FIG. 2. The cylinder 31 is adjustably secured in a sleeve 35, which is secured to the front face of the front member 24 of the supporting frame 23, substantially midway between the ends of the front member 24. The U-shaped member 34 has another leg 36, which is disposed in substantially parallel relation to the leg 33, and is secured to the latter by a bottom member 37, FIG. 2. The upper end portion of the leg 36 is secured by a suitable mounting bracket 37 to the upper end portion of a hydraulic cylinder 38, which is disposed laterally of the leg 36, FIGS. 2, 5 and 6. A hand crank 39 is secured to the upper end portion of the feed screw 32, and rotation of the hand crank 39 is effective to rotate the feed screw 32 in the cylinder 31 and thereby adjust the position of the feed screw 32 and the member 34 vertically relative to the cylinder 31 and the supporting frame 23.

Figure 6:
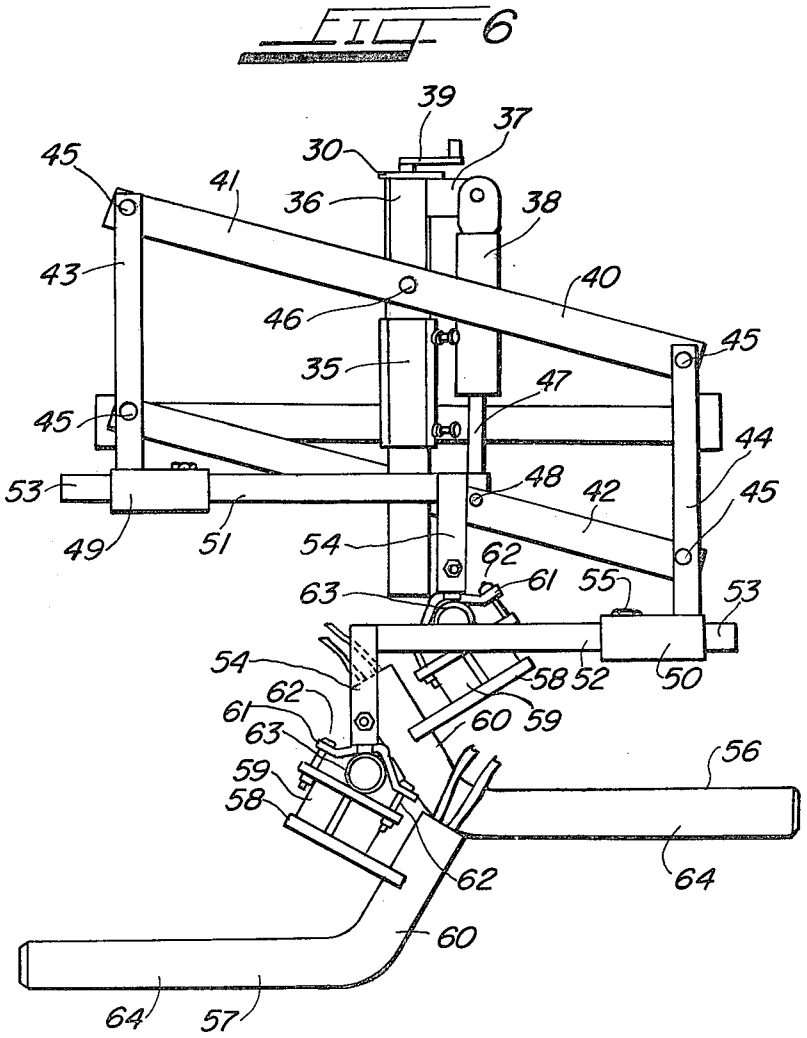
FIGS. 5 and 6 are front elevational views of the concrete finishing machine shown in FIG. 4, with parts thereof shown disposed in different operative positions.
Figure 5:
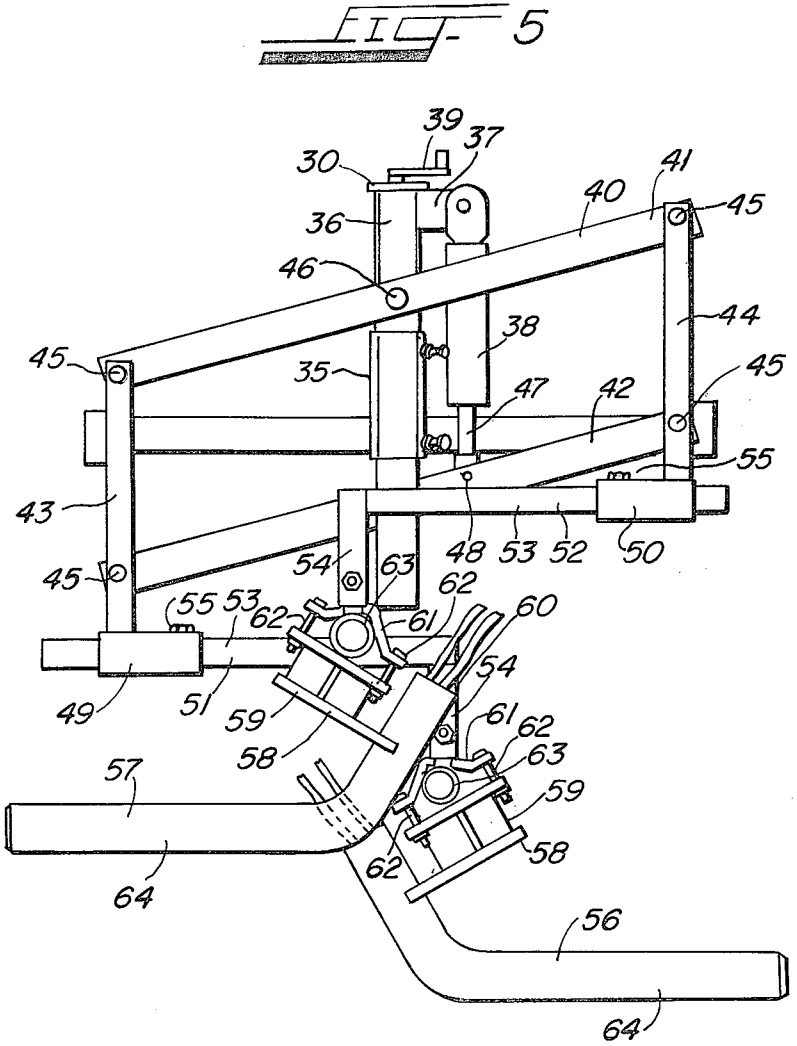

The concrete vibrator unit 1 also embodies an auxiliary supporting frame 40 in the form of a parallelogram, FIGS. 5 and 6, the frame 40 embodying two elongated, substantially prallel upper and lower bars 41 and 42, respectively, and two oppositely disposed, substantially parallel end bars 43 and 44, connected to respective opposite ends of the bars 41 and 42 by suitable means such as pins or bolts 45. The auxiliary supporting frame 40 is pivotally secured to the upper end portion of the leg 36 of the member 34 by a suitable pin or bolt 46, disposed substantially midway between the ends of the upper bar 41, FIGS. 5 and 6, so that the frame 30 is adjustable upwardly and downwardly with the leg 36 of the member 34 upon rotation of the hand crank 39.

A piston 47 is mounted in the hydraulic cylinder 38 for movement upwardly and downwardly therethrough, the piston 47 projecting downwardly from the lower end of the cylinder 38 and being pivotally secured to the lower bar 42 of the auxiliary supporting frame 40 by suitable means such as a pin or bolt 48, FIGS. 5 and 6. Movement of the piston 47 upwardly and downwardly in the cylinder 38 is effective to rotate the auxiliary supporting frame 40 around the pin 46 between the positions shown in FIGS. 5 and 6, respectively, for a purpose which will be discussed in greater detail presently.

The lower end portions of the end bars 43 and 44 of the auxiliary supporting frame 40 projects downwardly below the lower bar 42 thereof, and have elongated sleeves 49 and 50 secured thereto, by suitable means, such as, for example, welding, with the sleeves 49 and 50 disposed in substantially horizontally extending position. Two substantially L-shaped supporting members 51 and 52 are adjustably mounted in and supported by the sleeves 49 and 50, respectively. Each of the supporting members 51 and 52 embodies an elongated, substantially horizontally extending leg 53 and a vertically extending leg 54 projecting downwardly from one end of the respective leg 53. The legs 53 of the supporting members 51 and 52 are slidably mounted in the sleeves 49 and 50, respectively, in position to support the vertically disposed legs 54 in downwardly projecting position relative to the end legs 43 and 44 of the supporting frame 40. The position of the legs 54 laterally of the supporting frame 40 may be adjusted by sliding the legs 53 of the supporting members 51 and 52 longitudinally through the sleeves 49 and 50. The supporting members 51 and 52 may be releasably secured in adjusted position in the sleeves 49 and 50 by suitable means such as bolts 55 threaded into the sleeve 49 and 50.

Two vibrators 56 and 57 are adjustably secured, in a manner which will be discussed in greater detail presently, to the lower ends of the end legs 54 of the supporting members 51 and 52, respectively, FIGS. 5 and 6. The vibrators 56 and 57 may be of any suitable type readily available on the market, but, preferably, are hydraulically actuated vibrators having a substantially L-shaped configuration, as shown in FIGS. 5 and 6. In the preferred form of the concrete vibrator machine 1, shown in the drawings, each of the vibrators 56 and 57 includes a clamp-type mounting bracket 58 embodying a body portion 59 secured to one leg 60 of the respective vibrator 56 or 57, and a clamp bar 61 releasably secured to the body portion 59 by bolts 62 for adjustably, clampingly mounting the vibrators 56 and 57 on suitable supporting members 63, which, in the preferred form of the invention shown in the drawings, are short lengths of pipe projecting horizontally from the lower ends of the legs 54 of the supporting member 51 and 52, respectively, and secured thereto by suitable means, such as, for example, welding. In the preferred form of the invention shown in the drawings, the other legs 64 of each of the vibrators 56 and 57 is disposed at an obtuse angle to the first mentioned leg 60 thereof. It will be seen that, with this construction, by adjusting the position of the mounting brackets 58 of the vibrators 56 and 57 on the supporting members 63, the angle at which the legs 64 of the respective vibrators 56 and 57 are disposed relative to the horizontal may be readily adjusted, the bolts 62, when tightened, being effective to hold the respective vibrators 56 and 57 in adjusted position relative to the supports 63 on which they are mounted.

It will be seen that, as will be discussed in greater detail presently, with this construction, when the piston 47 is disposed in raised position in the cylinder 38, the auxiliary frame 40 is disposed in such position as to dispose the vibrator 57 in raised position and the vibrator 56 in lowered position, as shown in FIG. 5; and when the piston 47 is disposed in lowered position in the cylinder 38, the auxiliary supporting frame 40 is disposed in such position as to dispose the vibrator 57 in lowered position and the vibrator 56 in raised position, as shown in FIG. 6. Preferably, the movement of the vibrators 56 and 57 between fully raised and fully lowered position is effective to dispose them in upwardly withdrawn position relative to concrete to be vibrated, and to dispose them in the desired lowered position for vibrating the concrete, respectively. The height of the supporting frame 40, and, therefore, of the vibrators 56 and 57 relative to the roadway R may be adjusted by adjusting the vertical position of the cylinder 31 in the sleeve 35.

As will be discussed in greater detail presently, the hydraulic cylinder 38, by which the vibrators 56 and 57 are raised and lowered, is connected through a reversing valve 65, a speed control valve 66 and a pump 67 to an oil or hydraulic fluid reservoir 68, FIG. 9. In the concrete vibrator machine 1, the reversing valve 65 and the speed control valve 66 are mounted on the front end portion of the supporting frame 23, FIG. 3. The pump 67 and the reservoir 68 may be disposed at any suitable, desired location, such as, for example, adjacent to the control console 5 of the concrete finisher machine 2.

Figure 9:
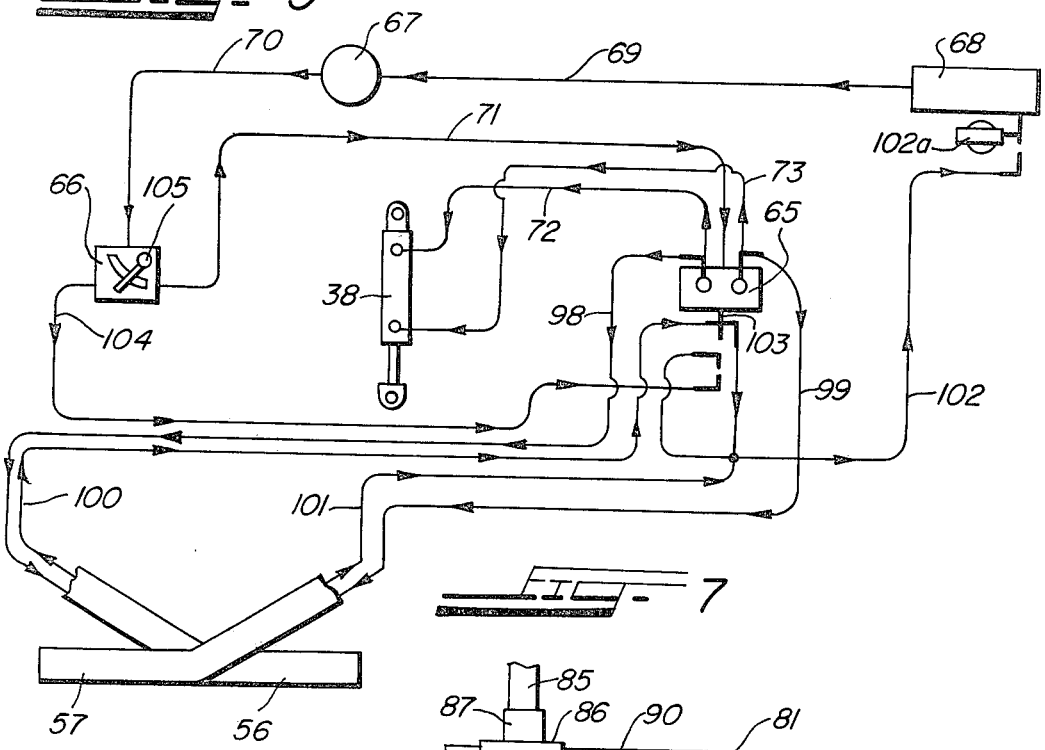
FIG. 9 is a diagram of the hydraulic circuit of the concrete vibrator machine shown in FIG. 1.

The reservoir 68 is connected by a conduit 69 to the inlet of the pump 67, for feeding working fluid to the pump 67, FIG. 9. The outlet of the pump 67 is connected by a conduit 70 to the inlet side of the speed control valve 66. One outlet of the valve 66 is connected by a conduit 71 to the inlet side of the reversing valve 65, two outlets of which are connected by conduits 72 and 73 to the upper and lower ends of the hydraulic cylinder 38, respectively.

Figure 7:
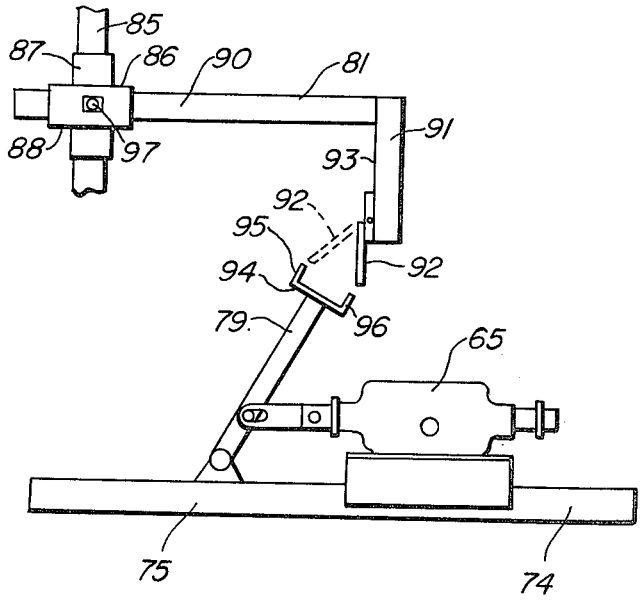
FIGS. 7 and 8 are fragmentary front elevational views of a portion of the machines shown in FIG. 1, with parts thereof disposed in different operative positions.
Figure 8:
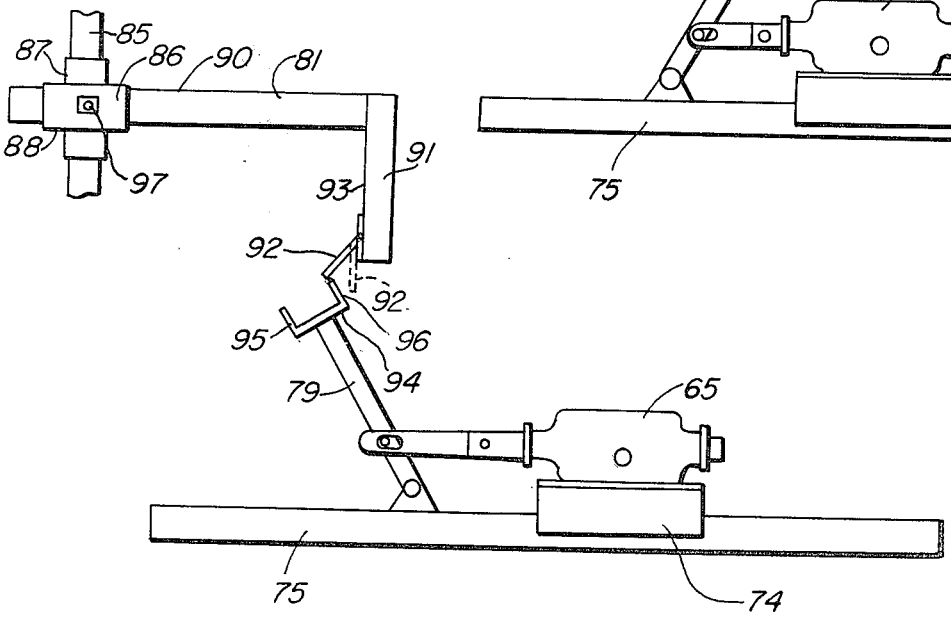

The reversing valve 65 is mounted on a platform 74, which is secured to an elongated supporting member 75, FIGS. 3, 7 and 8, which extends between the legs 25 and 26 of the supporting frame 23 in rearwardly spaced, parallel relation to the front end 24 thereof. The opposite ends of the supporting member 75 are secured to sleeves 76 and 77 slidably mounted on the legs 25 and 26, respectively, of the frame 23 for adjustment forwardly and rearwardly therealong. Bolts 78 are mounted in the sleeves 76 and 77 for releasably holding the latter in adjusted position on the legs 25 and 26, respectively.

A control lever 79 is povitally mounted on the supporting member 75 and projects upwardly therefrom, FIGS. 3, 7 and 8. The control lever 79 is operatively connected to the reversing valve 75 and is operable upon pivotal movement between the positions shown in FIGS. 7 and 8 to shift the valve 65 into position to feed working fluid from the conduit 71 outwardly through the conduits 72 and 73 into the upper and lower end portions of the hydraulic cylinder 35, respectively.

Two abutment members 80 and 81, for actuating the lever 79, and, therefore, the reversing valve 65, are mounted on the left and right end portions, respectively, of the concrete finishing machine 2, as viewed in FIGS. 1 and 3. The abutment members 80 and 81 are identical in construction, except that they are mirror images of each other, and each includes a substantially U-shaped supporting frame 82, FIG. 2, having an upper leg 83 slidably mounted in a sleeve 83*a*, secured to the top of the front sidewall of the frame 3 of the concrete finishing machine 2 by suitable means such as welding; a lower leg 84 slidably mounted in a sleeve 84*a*, secured to the lower edge of the front sidewall of the frame 3 of the machine 2; and a substantially vertically extending front leg 85 extending between the front end portions of the legs 83 and 84 in forwardly spaced relation to the frame 3 of the concrete finishing machine 2. A coupling member 86, in the form of two sleeves 87 and 88 disposed perpendicularly to each other is adjustably mounted on the front leg 85 of each of the supporting frames 82, the leg 85 extending through the sleeve 87 of the respective coupling member 86, and the sleeve 87 being adjustably secured to the leg 85 by a bolt 89, FIG. 2.

Each of the abutment members 80 and 81 also includes an elongated rod 90, slidably mounted in the sleeve 88 of a respective one of the coupling members 86, FIG. 1, and each of the rods 90 has a mounting member 91 mounted on and projecting downwardly from one end thereof, FIGS. 1, 7 and 8. The rods 90 of the abutment members 80 and 81 are so disposed in the sleeves 88 thereof that the mounting members 91 are on the ends of the respective rods 90, which are disposed closest to the adjacent ends of the supporting frame 3 of the concrete finishing machine 2.

Each of the mounting members 91 has a plate 92 hingedly mounted at its top edge on the face 93 of the mounting member 91, which faces inwardly toward the center of the machine 2, when the abutment members 80 and 81 are disposed in operative position thereon. The plates 92 are so disposed on the mounting members 91 that when they are disposed in vertical position they abuttingly engage the inner faces 93 of the respective mounting members 91 so as to prevent further outward movement of the plates 92 relative thereto. The hinged connection of the plates 92 to the mounting members 91, however, permits the plates 92 to swing inwardly relative to the mounting members 91, such as, for example, into the position thereof shown in broken lines in FIG. 7 and in solid lines in FIG. 8.

Each of the actuating levers has a substantially U-shaped actuating member mounted on the upper end thereof in upwardly opening position, FIGS. 7 and 8. In the operation of the concrete vibrator machine 1, as the surfacing unit 4 of the machine 2 approaches the end of its travel laterally across the highway R the actuating member 94 on the lever 79 engages the plate 92 on the abutment unit 80 or 81 disposed closest to that side of the highway R. Thus, for example, when the surfacing unit 4 is moving to the right, as viewed in FIG. 1, when it approaches the end of its travel across the highway R, the arm 79 is in the position shown in FIG. 7, and the inner leg 95 of the actuating member 94 moves into engagement with the plate 92. The plate 92, being in abutting engagement with the inner face 93 of the mounting member 91 on the abutment unit 81, it is effective to cause the arm 79 to move into the position shown in FIG. 8, as the reversing valve 65 and the arm 79 move past the plate 92, thus actuating the reversing valve 65. During reverse movement of the surfacing unit 4 across the highway 2, the outer leg 96 of the actuating member 94 again engages the plate 92 on the abutment unit 81, but merely causes it to pivot around its hinged connection to its adjacent mounting member 91, as shown in solid lines in FIG. 8, and, thus, the reversing vavle 65 is not again actuated thereby. However, when the surfacing unit 4 approaches its extreme left hand position on the highway R, as viewed in FIG. 1, the leg 96 on the actuating member 94 again engages the plate 92 on the abutment unit 80 to thereby cause the arm 79 to be moved back into the position shown in FIG. 7 and thus again actuate the reversing valve 65. By adjusting the position of the rods 90 in the sleeves 88 of the abutment units 80 and 81, the position at which the abutment units 80 and 81 are effective to actuate the reversing valve 65 may be readily adjusted. Bolts 97, mounted in the sleeves 88 are effective to hold the rods 90 in adjusted position therein. Also, the forward and rearward position of the lever 79, for properly engaging the plates 92 on the abutment members 80 and 81 may be readily adjusted by moving the sleeves 76 and 77, and, therefore, the supporting member 75 forwardly or rearwardly on the legs 25 and 26 of the supporting frame 23.

The outlets of the reversing valve 65, which are connected by the conduits 72 and 73 to the upper end and lower end, respectively, of the hydraulic cylinder 38 are also connected by conduits 98 and 99 to the inlet side of the vibrators 56 and 57, respectively, FIG. 9. The outlet sides of the vibrators 56 and 57 are connected by conduits 100 and 101, respectively, to a conduit 102 which is connected to the return side of the reservoir 68, a filter 102*a* preferably being disposed in the conduit 102.

The reversing valve 65 also has another outlet, which is connected by a conduit 103 to the return conduit 102 to the reservoir 68, so that when the lever 79 is in fully upright position, midway between the positions shown in FIGS. 7 and 8, fluid may flow through the reversing valve 65 into the conduit 103 and thus into the conduit 102 for return to the reservoir 68.

Similarly, the speed control valve 66 has another outlet, which is connected by a conduit 104 to the return conduit 102 to the reservoir 68. The valve 66 is so constructed that when the control 105 thereof is disposed in such position as to completely close the connection to the conduit 71, the working fluid entering the valve 66 through the conduit 70 may pass therefrom through the conduit 104 and the conduit 102 back to the reservoir 68.

From the foregoing it will be seen that when the concrete vibrator machine 1 is mounted on a concrete finishing machine, such as the machine 2, and both are in operation, as the surfacing unit 4 of the machine 2 moves from left to right, as viewed in FIG. 1, across a highway the reversing valve 65 is in the position shown in FIG. 7, so that hydraulic fluid is being fed therefrom into the upper end portion of the hydraulic cylinder 38 and the auxiliary supporting frame 40 is disposed in the position shown in FIG. 6, wherein the vibrator 57 is disposed in the concrete to be vibrated ahead of the machine 2 and the vibrator 56 is vertically withdrawn from the concrete. At the end of this travel of the surfacing unit 4, the actuating member 94 on the arm 79 engages the plate 92 on the abutment unit 81 to thereby trip the arm 79 into the position shown in FIG. 8 and actuate the reversing valve into the position wherein fluid is fed therefrom through the conduit 73 into the lower end portion of the hydraulic cylinder 38 to thereby move the auxiliary frame 40 into the position shown in FIG. 5 and raise the vibrator 57 from the concrete and lower the vibrator 56 into the concrete. Thus, during movement of the surfacing unit 4 back to the left, across the highway 2, as viewed in FIG. 1, the vibrator 56 is effective to vibrate the concrete disposed ahead of the finishing machine 2.

Between transverse movements of the surfacing unit 4 across the highway R. the concrete finishing machine 2, and therefore the concrete vibrator machine 1, may be moved forwardly along the rails 6 and 7 to the proper position for another concrete vibrating and concrete finishing operation.

It will be remembered that the vibrators 56 and 57 are horizontally adjustable, laterally of the highway 2, in the sleeves 49 and 50 so that the proximity to the rail 6 and 7, at the edges of the highway R, to which the vibrators 56 and 57 move during their vibrating operation, may be readily adjusted.

From the foregoing it will be seen that the present invention affords a concrete vibrator machine which may be an integral part of a concrete finishing machine, or which may be a separate machine. Thus, for example, if it is desired to have the concrete vibrator machine be a separate machine, the same construction as shown and described herein may be utilized except that the surfacing unit 4 would not embody the surfacing components thereof, such as the roller 13 and augers 14 and 15, and associated mechanism, but would merely constitute a carriage, such as the carriage 12, for the supporting frame 23. With such construction the resulting machine could be moved from right to left, as viewed in FIG. 1, ahead of a suitable concrete finishing machine, such as, for example, the machine shown in the aforementioned Glesmann U.S. Pat. No. 3,783,763.

From the foregoing, it will be seen that the present invention affords a novel concrete vibtrator machine for vibrating concrete to be laid on a highway or the like.

In addition, it will be seen that the present invention affords a novel concrete vibrator machine which may be used for vibrating concrete ahead of a concrete finishing machine.

Also, it will be seen that the present invention affords a novel concrete vibrator machine wherein the parts thereof are readily adjustable relative to each other so as to afford ready adjustment of such parts in substantially all directions with respect to a concrete finishing machine with which it may be used.

In addition, it will be seen that the present invention affords a novel concrete vibrator machine which is practical and efficient in operation and which may be readily and economically produced commercially Thus, while we have illustrated and described the preferred embodiment of our invention, it is to be understood that this is capable of variation and modification, and we therefore do not wish to be limited to the precise details set forth, but desire to avail ourselves of such changes and alterations as fall within the purview of the following claims.

We claim:

1. A concrete vibrator machine, for use in conjunction with a concrete finishing machine movable longitudinally along an elongated body of concrete and having a finishing unit engageable with the surface of the concrete and movable transversely across such a body of concrete, comprising a supporting member mounted to and extending outwardly from the finishing unit and movable therewith, and vibrator means mounted to said supporting member extending outwardly from the finishing unit and movable downwardly into and below the surface of the concrete and upwardly out of said direct contact with such a body of concrete and movable with said supporting member laterally thereacross in inserted position in said body of concrete.

2. A concrete vibrator machine as defined in claim 1, and in which said supporting member further includes an elongated supporting frame pivotable about a substantially horizontal pivot member for raising and lowering the opposite ends of said supporting frame, and said vibrator means comprises two vibrators mounted on respective end portions of said supporting frame and movable upwardly and downwardly therewith for lifting said vibrators from and inserting said vibrators into said direct contact with such a body of concrete.

3. A concrete vibrator machine, for use in conjunction with a concrete finishing machine movable longitudinally along an elongated body of concrete and having a finishing unit engageable with the surface of the concrete and movable transversely across such a body of concrete, comprising a supporting member mounted to and extending outwardly from the finishing unit and movable therewith, vibrator means mounted to said supporting member extending outwardly from the finishing unit and movable downwardly into and below the surface of the concrete and upwardly out of such a body of concrete and movable with said supporting member laterally thereacross in inserted position in said body of concrete.

said supporting member including an elongated supporting frame pivotable about a substantially horizontal pivot member for raising and lowering the opposite ends of said frame, said vibrator means comprising two vibrators mounted on respective end portions of said supporting frame and movable upwardly and downwardly therewith for lifting said vibrators from and inserting said vibrators into and below the surface of such body of concrete, and with said supporting frame being in the form of a parallelogram, embodying four pivotally connected sides.

4. A concrete vibrator machine for use in conjunction with a concrete finishing machine movable longitudinally along an elongated body of concrete and having a finishing unit engageable with the surface of the concrete and movable transversely across such a body of concrete, comprising a supporting member mounted to and extending outwardly from the finishing unit and movable therewith, vibrator means mounted to said supporting member extending outwardly from the finishing unit and downwardly into and below the surface of the concrete and upwardly out of such a body of concrete and movable with said supporting member laterally thereacross in inserted position in said body of concrete, said supporting member including an elongated supporting frame pivotable about a substantially horizontal pivot point for raising and lowering the opposite ends of said frame, said vibrator means comprising two vibrators mounted on respective end portions of said supporting frame and movable upwardly and downwardly therewith for lifting said vibrators from and inserting said vibrators into and below the surface of such a body of concrete, and wherein each of said vibrators comprising an elongated, substantially L-shaped member embodying a substantially horizontally disposed leg, and another leg projecting upwardly from said first mentioned leg, and being so disposed on said supporting frame that said first mentioned leg thereof is disposed in substantially horizontally extending position along the path of travel of said vibrator during said movement thereof laterally across said body of concrete.

5. A concrete vibrator machine as defined in claim 2, and which further includes reversing drive means operatively connected to said supporting frame for pivoting said supporting frame about said horizontal pivot point in opposite directions at respective ends of said movement of said vibrator means laterally across said body of concrete.

6. A concrete vibrator machine for use in conjunction with a concrete finishing machine movable longitudinally along an elongated body of concrete and having a finishing unit engageable with the surface of the concrete and movable transversely across such a body of concrete, comprising a supporting member mounted to and extending outwardly from the finishing unit and movable therewith, vibrator means mounted to said supporting member extending outwardly from the finishing unit and movable downwardly into and below the surface of the concrete and upwardly out of such a body of concrete and movable with said supporting member laterally thereacross in inserted position in said body of concrete, said supporting member including an elongated supporting frame pivotable about a substantially horizontal pivot point for raising and lowering the opposite ends of said frame, said vibrator means comprising two vibrators mounted on respective end portions of said supporting frame and movable upwardly and downwardly therewith for lifting said vibrators from and inserting said vibrators into and below the surface of such a body of concrete, reversing drive means operatively connected to said supporting frame for pivoting said supporting frame about said horizontal pivot point in opposite directions at respective ends of said movement of said vibrator means laterally across said body of concrete, wherein each of said vibrators comprising an elongated, substantially L-shaped member embodying a substantially horizontally disposed leg, and another leg projecting upwardly from said first mentioned leg, and being so disposed on said supporting frame that said first mentioned leg thereof is disposed in substantially horizontally extending position along the path of travel of said vibrator during said movement thereof laterally across said body of concrete, with said vibrators and said reversing drive means for pivoting said supporting frame being hydraulically actuated units, and control means for feeding hydraulic fluid to said vibrators and to said reversing drive means for pivoting said vibrators.

7. In a concrete finishing machine embodying an elongated supporting carriage adapted to travel in a direction transverse to the length thereof, a surfacing unit mounted on said carriage for movement longitudinally thereof, drive means operatively connected to said surfacing unit for moving the latter longitudinally of said carriage, and reversing drive means operatively connected to said drive means for reversing the direction of movement along said carriage, a supporting member mounted on and movable with said surfacing unit, vibrator means movable downwardly into lowered position and upwardly into raised position relative to said surfacing unit, said vibrator means being mounted on said supporting member and movable therewith longitudinally of said carriage, and control means for vibrating said vibrator means.

8. The combination in a concrete finishing machine as defined in claim 7, and in which said vibrator means comprises elongated vibrators disposed in position for movement substantially longitudinally thereof during said movement of said vibrator means longitudinally of said carriage.

9. The combination in a concrete finishing machine as defined in claim 7, and in which said supporting member comprises a supporting frame mounted on said surfacing unit and an elongated supporting element privotally mounted on said supporting frame for oscillation relative thereto for raising and lowering the opposite ends of said elongated supporting element, and said vibrator means comprises two vibrators mounted on respective end portions of said elongated supporting element for upward and downward movement therwith, and which includes oscillating means operatively connected to said elongated supporting element for oscillating the element.

10. The combination in a concrete finishing machine as defined in claim 9 wherein each of said vibrators comprises a substantially L-shaped member having a lower leg, and an upper leg projecting upwardly from one end of said lower leg, and wherein each of said vibrators are mounted on said elongated element in position wherein the end of said lower leg remote from said upper leg thereof is disposed in trailing position during movement thereof longitudinally of said carriage of said finishing machine, and is disposed in said lowered position thereof during said movement thereof longitudinally of the carriage of said finishing machine.

11. The combination in a concrete finishing machine as defined in claim 10, and in which said vibrators are of the hydraulically actuated type, and said oscillating means for oscillating said elongated supporting element comprises a hydraulic cylinder unit mounted on said supporting frame and having a piston operatively connected to said elongated supporting element, and which includes conduits for feeding hydraulic fluid to said vibrators and to said hydraulic cylinder unit for actuating the same.

12. The combination in a concrete finihisng machine as defined in claim 11, and in which said conduits for feeding hydraulic fluid includes a reversing valve operatively connected to said hydraulic cylinder unit for controlling the acuation thereof and thereby controlling the raising and lowering of said vibrators, and operatively connected to said vibrators for feeding hydraulic fluid thereto when said vibrators are disposed in lowered position and preventing hydraulic fluid being fed thereto when said vibrators are disposed in raised position.

13. The combination in a concrete finishing machine as defined in claim 12, and which includes stop means mounted on said opposite end portions of said element of said concrete finishing machine for actuating said reversing valve when said surfacing unit moves therepast toward the adjacent end of said last mentioned frame.

14. The combination in a concrete finishing machine, as defined in claim 13, and in which said elongated supporting element comprises a parallelogram having an upper bar, a lower bar and two end bars pivotally connected together, said upper bar pivotally mounted at the longitudinal center portion thereof on said first mentioned supporting frame, and said lower bar operatively connected to said piston of said hydraulic cylinder unit.

* * * * *